US006634198B2

(12) United States Patent
Dudziak

(10) Patent No.: US 6,634,198 B2
(45) Date of Patent: Oct. 21, 2003

(54) METHOD FOR PRODUCING A CIRCUMFERENTIALLY CLOSED HOLLOW PROFILE AND DEVICE FOR PERFORMING THE METHOD

(75) Inventor: Kai-Uwe Dudziak, Stelle (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 10/026,090

(22) Filed: Dec. 21, 2001

(65) Prior Publication Data

US 2002/0088263 A1 Jul. 11, 2002

(30) Foreign Application Priority Data

Dec. 23, 2000 (DE) ..... 100 65 033

(51) Int. Cl.[7] ..... B21D 9/15; B21D 26/02; B21D 39/08

(52) U.S. Cl. ..... 72/57; 72/58; 72/61; 29/421.1

(58) Field of Search ..... 72/55, 57, 58, 72/61, 62; 29/421.1

(56) References Cited

U.S. PATENT DOCUMENTS 2,423,862 A * 7/1947 Vorobik ..... 72/63
3,888,098 A * 6/1975 Larrimer et al. ..... 72/63
5,813,266 A * 9/1998 Ash ..... 72/57
5,829,137 A * 11/1998 Grassi ..... 72/63
5,987,950 A * 11/1999 Horton ..... 72/58
6,105,409 A * 8/2000 Kojima et al. ..... 72/58
6,134,931 A * 10/2000 Glaesener ..... 72/58
6,415,638 B1 * 7/2002 Sakurai et al. ..... 72/57

FOREIGN PATENT DOCUMENTS

EP 0 913 277 5/1999

* cited by examiner

*Primary Examiner*—David B. Jones
(74) *Attorney, Agent, or Firm*—Kenyon & Kenyon

(57) ABSTRACT

In a method and a device for producing a circumferentially closed hollow profile, a hollow-profile blank is expanded by fluidic internal high pressure in an internal high-pressure forming tool, after which the hollow-profile blank assumes the final shape of the hollow profile. In order to make it possible in a simple manner to have a production of a hollow profile in which process reliability is ensured to a sufficient extent even in the case of high expansions of the hollow profile (higher than or equal to the breaking elongation of the material), during expansion, the hollow-profile blank is supported, on at least one partial circumferential region, by at least one diaphragm fastened to the inside, facing the blank, of the tool and capable of being acted upon by a controllable pressure acting from outside, the diaphragm shifting back elastically as expansion progresses, with the supporting pressure acting on the diaphragm being reduced at the same time.

17 Claims, 4 Drawing Sheets

METHOD FOR PRODUCING A CIRCUMFERENTIALLY CLOSED HOLLOW PROFILE AND DEVICE FOR PERFORMING THE METHOD

FIELD OF THE INVENTION

The present invention relates to a method for producing a circumferentially closed hollow profile and to a device for performing the method.

BACKGROUND INFORMATION

A generic method and a generic device are described in European Published Patent Application No. 0 913 277. A wishbone of a wheel suspension may be gathered from this, the wishbone being manufactured from a tube by internal high-pressure forming. The wishbone has various cross-sectional shapes, one of these being a flattened rectangle. In order to produce this shape, the circular-cylindrical prebent tube is introduced into an internal high-pressure forming tool divided into two and, during the closing operation, is squeezed together by the two die parts. Subsequently, with the tool closed, the tube is expanded by internal high pressure, until it is to come to bear exactly to contour against the die impression, and therefore the desired flat rectangular final shape is to be obtained. During squeezing actions of this type, which cause folds, in conjunction with volume-enlarging expansions by internal high pressure, however, a failure of the material often occurs, this being due to an appreciable extent to the strain-hardening of the material achieved after the squeezing operation or to the excessive partial ironings of material in the regions which have not yet come to bear. The failure of the material is manifested, in this case, by the tearing or breaking of the tube or hollow profile. The generally known counterstays cannot be used in this case in order to eliminate this defect, since, on the one hand, the solid counterstays cannot become correspondingly narrower during the squeezing of the tube. On the other hand, the contour of the supporting surface of the plunger is invariable, so that the bearing contact of the tube, whether during the squeezing operation or during the expansion phase, is at no time equally distributed, thus leading to a non-uniform support of the tube and therefore contributing to the failure of the tube at this supported point or in the regions adjacent to the counterstay.

Even a straightforward expansion of a tube of circular cross-section with high degrees of expansion, in which the cross-sectional shape is maintained, does not proceed, when free of support, in a reliable way in terms of the process, since the rate of expansion increases and the tube material would fail when it reached its breaking elongation. In order to counteract this, conventional solid counterstays are used, by which controlled expansion is possible, but limits are also placed on it, since, of course, the tube material comes to bear against the counterstay and experiences there appreciable friction which is detrimental to expansion. Moreover, all-around support by conventional counterstays is virtually impossible during the entire expansion process, thus leading, as described above, to the failure of the tube material in the regions adjacent to the respective counterstay.

It is an object of the present invention to provide a method and a device, to the effect that it becomes possible in the simple manner to perform a production of a hollow profile in which, even in the case of high expansions of the hollow profile (higher than or equal to the breaking elongation of the material), process reliability is ensured to a sufficient extent.

SUMMARY

The above and other beneficial objects of the present invention are achieved by providing a method and device as described herein.

In accordance with the present invention, by the diaphragm, a flexible counterstay is formed, which, during expansion forming and also in other forming processes, may adapt to any shape of the hollow-profile blank exactly to contour and in a large area over a relatively large partial circumferential region of the hollow-profile blank. The contour-matching expansion and supporting force of the diaphragm, achieved by the external application of pressure, may be adjusted very accurately to the forming progress by the simple-to-handle pressure control parameters. Overall, that is to say, owing to the large-area bearing contact—circumferentially complete bearing contact if a plurality of diaphragms distributed in the circumferential direction are used—, during each forming phase and as a result of accurate metering of the supporting force, the hollow-profile blank to be formed receives the appropriate uniform supporting force which prevents a failure of the blank material during expansion. The process reliability of the forming process is thereby ensured, even in the case of very high expansions. What is meant by high expansion is an expansion higher than or equal to the breaking elongation of the material. A diaphragm resistant to high pressure is simple to produce and to fasten and, overall, constitutes only a very low outlay in terms of apparatus. Furthermore, existing forming tools may readily be retrofitted with the diaphragm. Due to the elasticity of the diaphragm, during the interaction of the two oppositely directed pressures of the constant or increasing internal high pressure in the hollow-profile blank and of the pressure, decreasing during expansion, of the external application of pressure to the diaphragm, the latter is withdrawn from the cavity, while maintaining bearing contact which is exact to contour. As a result, as regards the entire forming process, the production of a flattened final shape may thus also occur reliably in terms of the process.

The present invention is explained in more detail below with reference to an example embodiment illustrated in the Figures.

DETAILED DESCRIPTION

The advantages of the present invention will become clear from the following example embodiments which do not simply refer "only" to the generation of a hollow profile with very high expansions, but are also directed at the production of an additionally flattened hollow profile, substantially more difficult with regard to maintaining process reliability, so that a very flat, but extremely wide final shape of the hollow profile is achieved.

Figure 1:
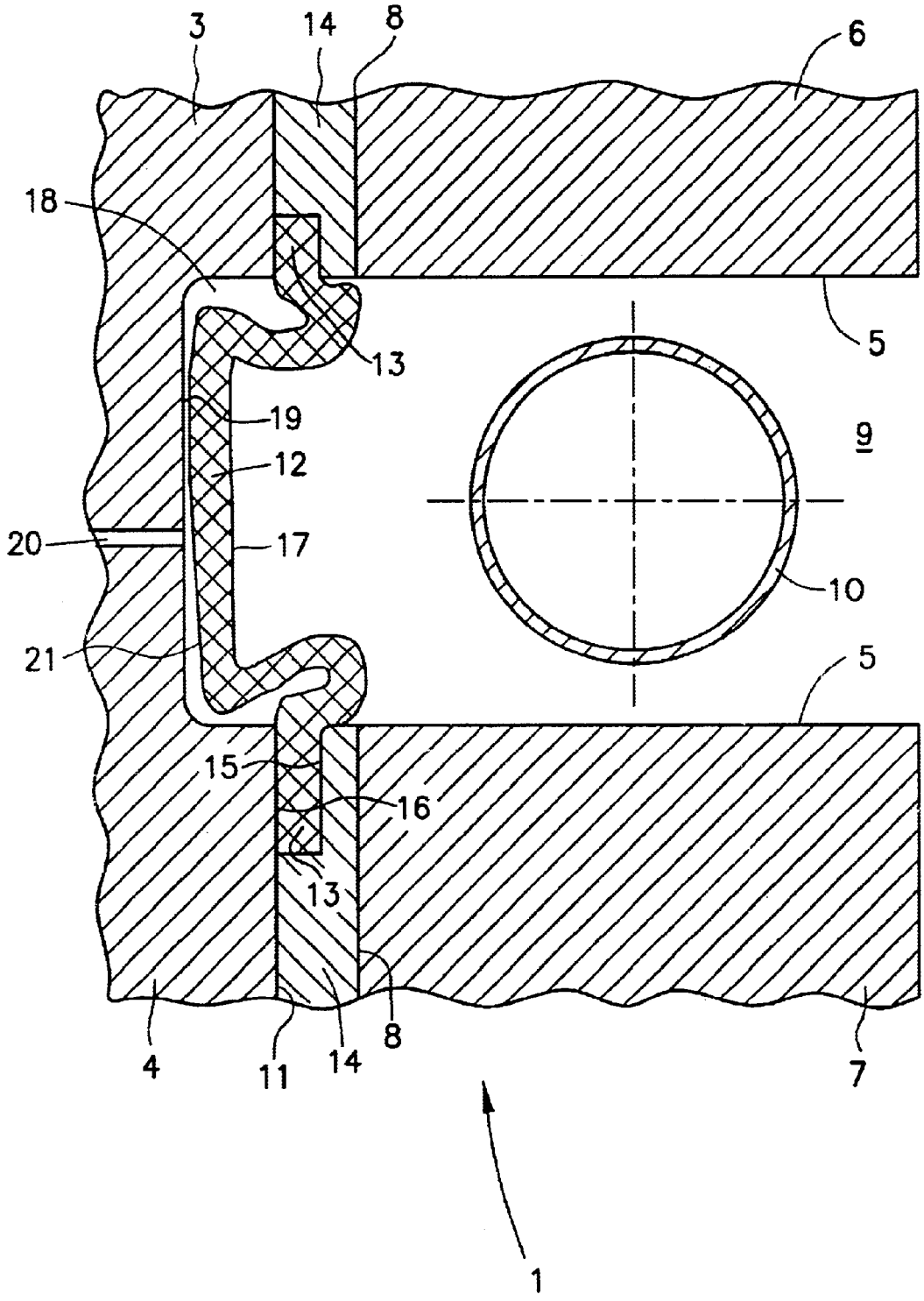
FIG. 1 is a cross-sectional view of a device according to the present invention, with the diaphragm in a position of non-use, prior to the forming of the hollow-profile blank.

FIG. 1 illustrates a device 1 for producing a circumferentially closed flattened hollow profile 2 (FIG. 4), the device consisting essentially of an internal high-pressure forming tool divided into two lateral tools, of a diaphragm 12 and of a flattening device. The lateral tools may in each case be configured in one piece, a pressure-medium feed 20 being incorporated there. However, the lateral tools may also have a multi-part configuration, divided into an upper side tool 3 and a lower side tool 4, in which case the pressure-medium feed 20 may extend in the parting plane of the two side tools 3 and 4. To equip the forming tools with a blank 10, a manipulator is to be used, which holds the blank 10 until the two pairs of side tools 3, 4 have closed, jaw-like, around the blank 10. After forming, the ready-formed hollow profile may be removed from the forming tool in a simple manner, solely by the action of gravity, when the side tools 3 and 4 are moved apart from one another. It may, however, also be possible, alternatively, to configure the upper side tool 3 with a removable cover part, so that, with the side tools 3, 4 closed, with the exception of the cover part, the forming tool may be equipped via the orifice of the forming tool occurring in the absence of the cover part, without blank-holding manipulators being used. Only after the cover part closes the equipment orifice may forming then commence. The removal of the finished hollow profile occurs by gravity in the same manner as in the above-described variant of the forming tool.

Although the flattening device may simply be the pair of side tools 3 and/or the pair of side tools 4 by a correspondingly configured impression, in the present example embodiment the flattening device includes two mutually opposite plungers 6 and 7 which are in alignment with one another and are guided displaceably in leadthroughs 8 of the upper pair of side tools 3 and of the lower pair of side tools 4 and which are capable, in this case, of being moved into the cavity 9 which is formed by the side tools 3 and 4 and in which the hollow-profile blank 10 initially provided with a circular-cylindrical cross-section is received, the plungers being capable of exerting a squeezing action on the blank 10. The use of a single plunger may also be possible. The plungers 6 and 7 may be configured continuously in adaptation to the longitudinal extend of the internal high-pressure forming tool and therefore to the entire formable part of the hollow-profile blank 10 or, alternatively, be arranged only locally in order to act upon a portion of the blank 10. The plungers 6, 7 have a planar end face, so that, on the one hand, the required flat final shape of the hollow profile 2 is achieved and, on the other hand, no indentations caused by sharp-edged unevennesses of the plunger surface and detrimental to process reliability occur on the blank 10.

An elastic diaphragm 12 consisting, for example, of an elastomer or a rubber is fastened to the tool inside 11 over the length of the forming region of the hollow-profile blank 10 and so as to extend laterally of the zone of engagement of the plungers 6 and 7 which may be identical to the cavity 9. The fastening of the diaphragm 12 may be performed in many different manners, for example, unreleasably by adhesive bonding, screwing, riveting, etc. In the present case, the diaphragm 12 may be received, so as to be exchangeable in the event of wear, at the two flange-like ends 13 arranged transversely to the longitudinal extent of the tool and parallel to the plungers 6 and 7, in each case in a holder 14.

The holder 14 is mounted releasably on the inside 11 of the tool, the holder 14 having a clearance 15 which forms a receptacle, open to the inside 11, for the diaphragm 12 and between the walls of which and the opposite wall portion 16 of the tool inside 11 the diaphragm flanges 13 are clamped. Although the diaphragm 12 may have a planar portion between its flanges 13 in the position of non-use, i.e., in the relaxed position, the diaphragm 12 has a U-shaped configuration, in order to obtain a greater reach into the cavity 9 for the method explained below. With regard to the shape of the diaphragm 12, a recess 18 extending along the middle part 17 of the diaphragm 12 is incorporated into the inside 11 of the tool, in order to receive the diaphragm 12 to an extent such that, when the diaphragm 12 is in the position of non-use and in the last forming phase of the blank 10, the cavity 9 is diaphragm-free and therefore, on the one hand, the diaphragm 12 does not cause an obstruction when the cavity 9 is being equipped with a blank 10 and, on the other hand, the diaphragm may be withdrawn from the cavity 9 during the forming of the blank 10.

A duct-like pressure-medium feed 20 issues into the recess bottom 19 and is connected to a pressure generator located outside the tool. The diaphragm 12 thus covers the recess 18, together with the issue of the pressure-medium feed 20, in a manner tight to high pressure, with the result that, when the pressure medium is introduced, a pressure space 22 is formed between the recess bottom 19 and the outside 21, facing the latter, of the diaphragm 12. By virtue of the configuration of the recess 18, the pressure imparted via the pressure medium is distributed uniformly to the entire diaphragm 12, with the exception of the clamped flanges 13, so that local damaging elongations of the diaphragm 12 under the application of pressure are avoided and the desired bearing contact against the hollow-profile blank 10 is achieved to a sufficient extent over a partial circumferential region of the blank 10. Although the pressure medium may be gaseous, here, however, it is a pressure fluid because of its incompressible properties which may be advantageous for support during the forming of the blank 10.

Although only a single diaphragm is illustrated in the example embodiment, a plurality of diaphragms may, however, be lined up with one another on each side within the scope of the invention. This may be advantageous when the blank 10 is to be formed by expansion and flattening on only a plurality of longitudinal portions spaced from one another. In this case, the blank 10 may be supported to a differing extent, depending on the desired cross-sectional shape of the hollow profile, by pressure controls of the pressure fluid which are specific to the blank portions. By contrast, the diaphragm 12 may also extend, in a manner involving a low outlay in terms of apparatus, along the entire cavity of the tool, specifically even where only one of the two forming steps, expansion and flattening, or else no forming occurs. The hollow-profile blank 10 is thus supported over its entire longitudinal extent by the diaphragm 12. The pressure in the pressure space 22 may be controlled according to the forming progress. This may occur by a control of the pressure generator or by a control of a pressure-limiting valve.

As illustrated in the Figures, it may also be possible that the internal high-pressure forming tool includes an upper tool and a lower tool instead of side tools 3, 4, with the result that the equipping of the cavity 14 may proceed relatively simply. Since, with the drawings interpreted as being correspondingly transposed, the diaphragm 12 connects the upper tool to the lower tool, the diaphragm 12 is stretched and compressed during the opening and closing of the tool, with the result that the diaphragm 12 is exposed to increased wear. This may be avoided, however, by a removable cover part located in the upper tool and covering the cavity only, the diaphragm 12 remaining unstressed during the opening and closing movement of the forming tool. In order to relieve the diaphragm 12 it may, alternatively, be advantageous to rotate the IHF tool arrangement consisting of the upper tool and of the lower tool through 90° anti-clockwise. In this case, the arrangement may be configured so that a diaphragm 12 is arranged in the lower tool and a diaphragm 12 in the upper tool, the middle part 17 of the diaphragms 12 extending horizontally. In the alternative described, the pressure-medium feed 20, which then, as illustrated in the Figures, is arranged exactly in the parting plane of the upper tool and lower tool and may thus be formed in each case by a channel-like groove of the two tool halves, may be provided separately both in the lower tool and in the upper tool. In this version, the IHF tool may be opened and closed, without the diaphragm 12 being in any manner subjected to mechanical stress, thus, on the one hand, minimizing the wear of the diaphragm and, on the other hand, optimizing access to the equipment space of the tool.

In order to produce the flattened hollow profile 2, first a flattening of the blank 10 may occur, the latter subsequently being expanded in the flattened state by internal high pressure. In order to improve process reliability, prior to flattening, a pressure may be built up in the pressure space 22, which protrudes the diaphragm 12 and expands it toward the blank 10, until the diaphragm 12 bears snugly against the latter on a partial circumferential region. During subsequent flattening, in which the plungers 6, 7 move toward one another and thus reduce the cavity 9, the blank 10 is squeezed and widened in the width direction toward the recess 18. In this case, the pressure in the pressure space 22 must be reduced, in order to allow this widening. In this process, the elastic diaphragm 12 shifts out of the cavity 9 back into its recess 18, until it has completely left the zone of engagement of the plungers 6, 7. For the expansion of the flattened blank 10, the diaphragm 12, to which increased pressure from the pressure space 22 is applied, then stops laterally of the plungers 6, 7 and supports the blank 10 so that, on the latter, a wall 24 flush with the plunger outside 23 may be formed. The flushness achieved depends on the cross-sectional shape requirement (e.g., rectangular cross-section).

Other shape profiles of the wall 24 may also be formed, depending on the position of the diaphragm 12 in relation to the plungers 6, 7. In order to increase the process reliability by as far as possible preventing folds from occurring during flattening, it may be beneficial to generate in the blank 10, during flattening, a hydraulic supporting pressure which counteracts the folding. Flattening may also occur as a result of the closing of the tool 1 itself. This presents problems, however, since the diaphragm 12, which is under pressure so as to come to bear against the blank 10, may possibly swell out of the still open tool and may be damaged when being pressed back by the tool. Although flattened hollow profiles 2 may be produced with the method variant presented, it is restricted to hollow profiles which are not to be particularly wide and flat. The underlying reason for this is that, during flattening, the blank material already comes to bear against the end faces 5 of the plungers 6, 7 at many points, so that, during expansion by internal high pressure, there is, even initially, a considerable friction of the blank 10 against the plunger end faces 5. This leads, in the case of a stipulation where a very wide and flat hollow profile 2 is to be produced, to a bursting of the blank 10 during expansion. Also, as a result of the friction which obstructs the flow of the blank material, the deep folds occurring to an increased extent during intensified flattening may no longer be pressed out by the internal high pressure with process reliability.

In order to solve this problem and consequently achieve any desired variability in the configuration of cross-sectional shapes of the hollow profile with process reliability, in a further method variant, the blank 10 is configured and placed in relation to its surroundings in the tool so that there is a relatively long distance from the end faces 5 of the plungers 6, 7 over the portion to be formed (FIG. 1). This allows a free frictionless expansion of the blank 10, so that the circumference and diameter of the blank 10 may be increased sharply without the risk of bursting. In this variant, therefore, free expansion is the first forming step of the blank 10, which is ended when the expanded blank 10 comes into contact with the plunger end faces 5.

Figure 2:
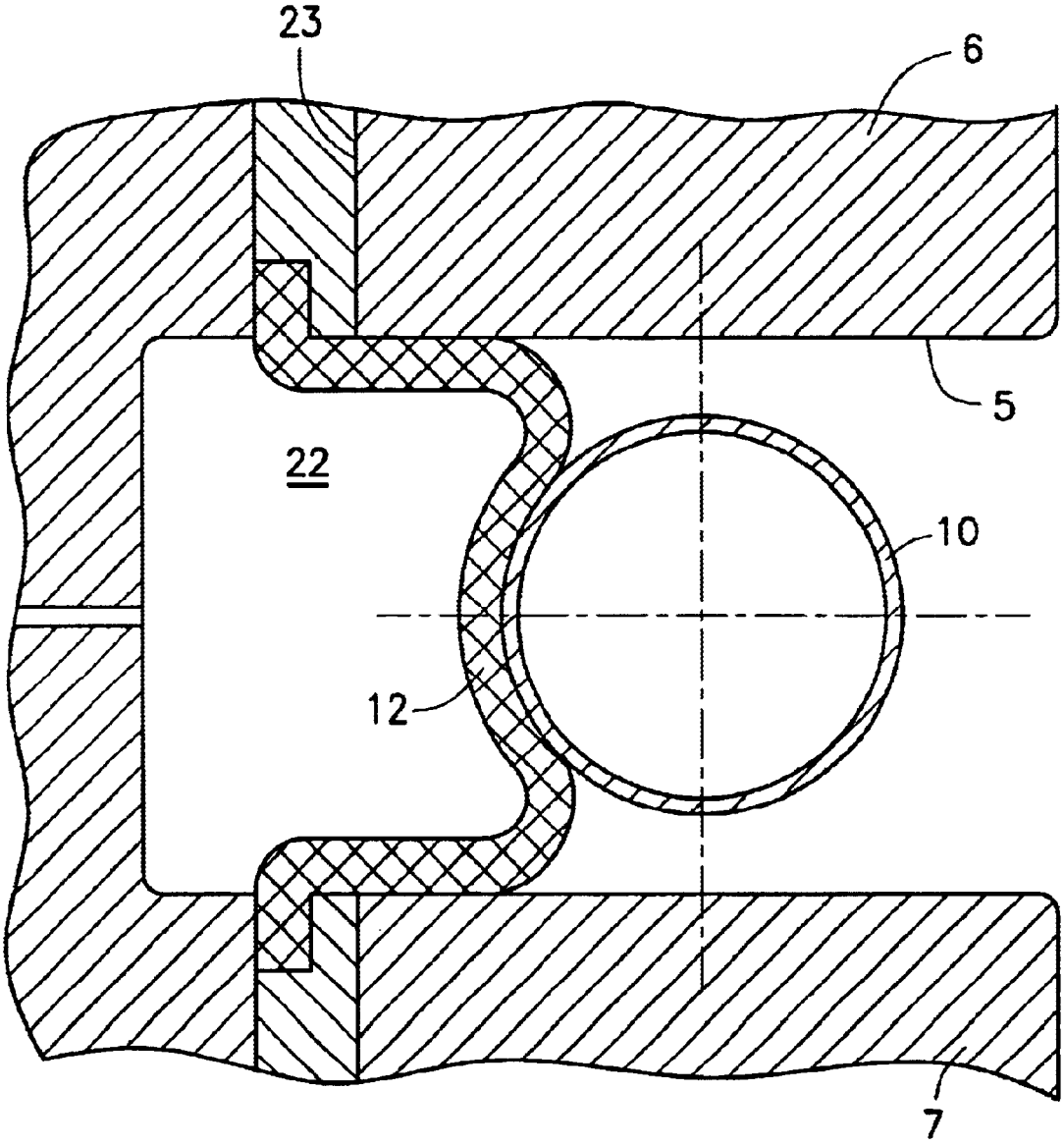
FIG. 2 is a cross-sectional view of the device illustrated in FIG. 1, with the diaphragm in the position of use, prior to the forming of the hollow-profile blank.
Figure 3:
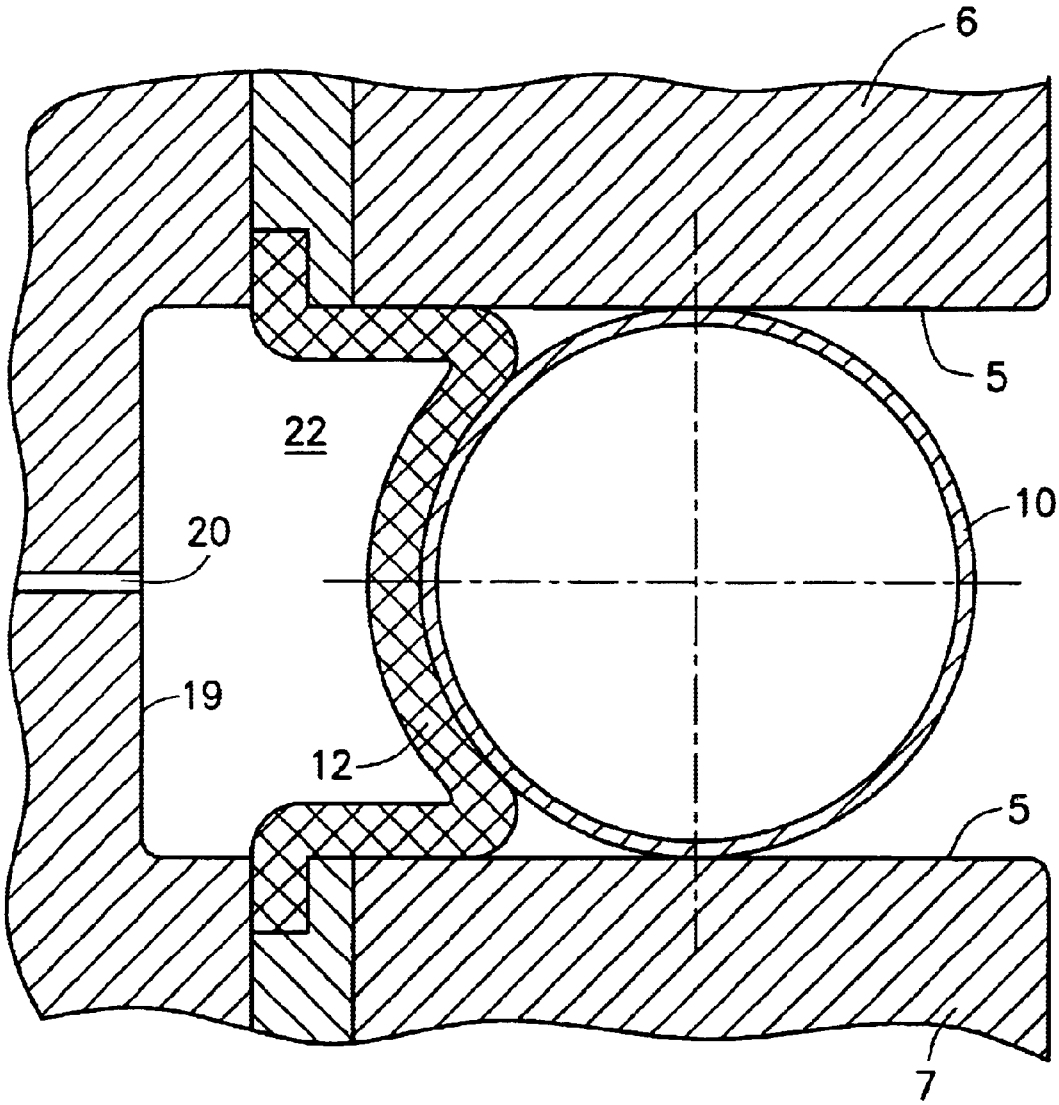
FIG. 3 is a cross-sectional view of the device illustrated in FIG. 1, with the diaphragm in the position of use, after the expansion of the hollow-profile blank.

Even before an internal high pressure is generated in the blank 10, the diaphragm 12 has pressure applied to it from the pressure space 22 and thereby comes to bear against a partial circumferential region of the blank 10 and against a portion of the plunger end faces 5 (FIG. 2). By a fluidic internal high pressure being generated, the blank 10 is then expanded, during the entire expansion pressure being applied to the diaphragm 12 and the latter being pressed against the blank 10 on the partial circumferential region. The diaphragm 12 supports the blank 10 there in a material-steadying and dimensionally stable manner, so that the expansion phase proceeds with full process reliability (FIG. 3). At the same time, the expanding blank 10 forces the diaphragm 12 back toward the pressure space 22, the supporting pressure in the pressure space 22 being reduced in a continuously adapted manner with a rising degree of expansion. Although the diaphragm 12 bears against the blank 10 during expansion, there is no or only very slight friction over the blank material on the diaphragm 12, since the latter is not solidly firm and is deformed elastically in accompaniment. After expansion is concluded, the diameter of the blank 10 is approximately as large as the plunger width.

Figure 4:
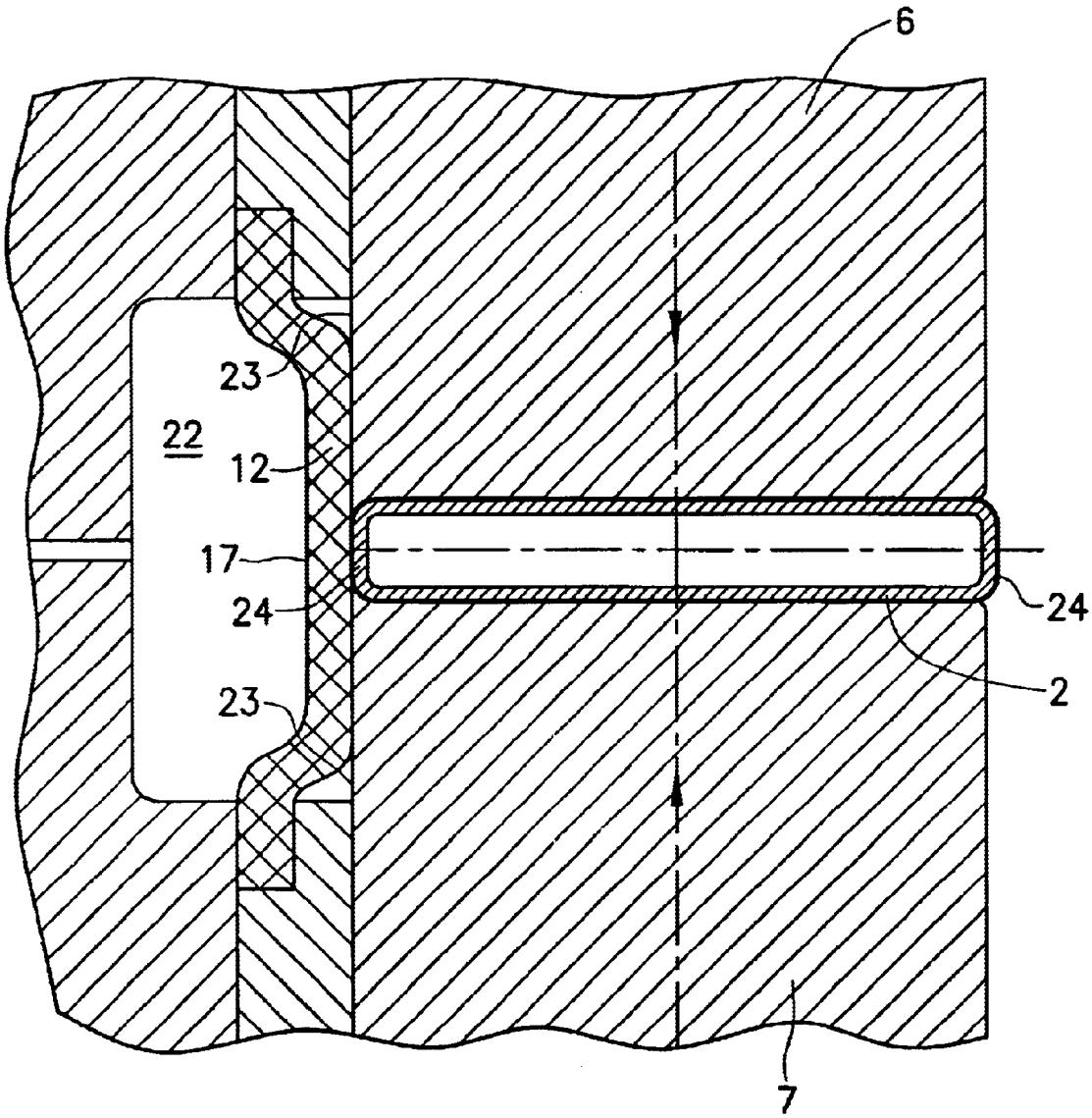
FIG. 4 is a cross-sectional view of the device illustrated in FIG. 1, with the diaphragm in the position of use, after the flattened final shape of the hollow profile is achieved.

As illustrated in FIG. 4, the plungers 6, 7 are moved towards one another in the direction of the arrows, with the result that the expanded blank 10 is compressed. Although the blank 10 does not necessarily have to be supported by the diaphragm 12 and beyond a fluidic supporting pressure which may be lower than the expansion pressure, it may be advantageous for further process reliability if this is afforded. In this case, the blank 10 is pressed, free of folds, into a flattened final shape of the circumferentially closed hollow profile 2 of rectangular cross section. The blank 10 is at the same time widened even further, without damage, until it has assumed the final shape. The widening induced by flattening supplements the main share of the entire widening which is provided by the expansion. As illustrated in FIG. 4, the blank 10 is supported continuously and, during flattening, has pressure applied to it by the diaphragm 12 so that, when flushness of the flattened blank 10 with the outside 23 of the plungers 6, 7 is achieved, the final lateral contour of the hollow profile 2 is produced. The middle part 17 of the diaphragm 12 in this case bears longitudinally against the outside 23 of the plungers 6, 7. Even during flattening, the pressure in the pressure space 22 is reduced successively, so that the diaphragm 12 may shift back elastically until the flushness of the wall 24 carrying the final contour of the hollow profile 2 with the plunger outside 23 is achieved.

It is conceivable that sharp edges are required for the final shape of the hollow profile 2. In this case, finally, the expanded and flattened hollow-profile blank 10 may be calibrated into the final shape of the hollow profile 2 by an internal high pressure exceeding the expansion pressure, in which case the pressure fluid in the pressure space 22 must apply the corresponding counterpressure.

Furthermore, it is possible to eliminate active flattening during the production process. In this case, to simplify the process, not only a technique of the method, but also the associated plungers 6, 7 and their control, are omitted. The internal high-pressure forming tool may then be configured so that the insides 11 of the tool are planar, so as to form a box shape, with the result that the production of the flattened hollow profile 2 occurs in a single expansion, supported by the diaphragm 12, if appropriate with final calibration. Due to the early friction-inducing bearing contact of the blank material against the tool inside 11, the possibilities of shaping the hollow profile 2 in terms of height and width are restricted considerably, and therefore only low degrees of forming are possible with process reliability.

The device according to the present invention makes it possible, as compared with conventional method techniques, that two manufacturing steps, which differ in the shaping direction and which would normally be performed in two manufacturing stages, may be executed in one internal high-pressure operation. Furthermore, by the flexible diaphragm 12, workpieces with expansions may be produced, which, by virtue of their geometric configuration and the associated frictional obstruction between workpiece and tool, may not be formed with any process reliability. For example, the workpieces mentioned may be long IHF components which may have narrowly tapering expansion regions, such as the crossmember running under the windscreen in motor vehicle body construction.

What is claimed is:

1. A method for producing a circumferentially closed hollow profile, comprising the steps of:

expanding a hollow-profile blank by fluidic internal high pressure in an internal high-pressure forming tool after which the hollow-profile blank assumes a final shape of the hollow profile, the tool having an inside, an outside, and a diaphragm fastened to the inside of the tool facing the hollow-profile blank, the diaphragm configured to be acted upon by a controllable supporting pressure acting from the outside;

supporting the hollow-profile blank during the expanding step on at least one partial circumferential region by the diaphragm; and shifting the diaphragm from a first position to a second position elastically during the expanding step and simultaneously reducing the supporting pressure.

2. The method according to claim 1, further comprising the step of flattening the hollow-profile blank in the internal high-pressure forming tool.

3. The method according to claim 2, wherein the tool includes a flattening device and the expanding step includes the substep of free expanding the hollow-profile blank until the hollow-profile blank contacts the flattening device, and wherein the flattening step is performed after the expanding step, the hollow-profile blank being continuously supported by the diaphragm in the supporting step during the expanding step and the flattening step.

4. The method according to claim 3, wherein the flattening device includes an outside and the supporting step includes the substep of applying pressure to the hollow-profile blank by the diaphragm so that when the flattened hollow-profile blank is flush with the outside of the flattening device, a final lateral contour of the hollow profile is produced.

5. The method according to claim 3, wherein the flattening step directly results in the final shape of the hollow profile in accordance with an internal high pressure supporting the hollow-profile blank from inside lower than the expansion pressure.

6. The method according to claim 1, wherein the hollow-profile blank is supported in the supporting step over an entire longitudinal extent by the diaphragm.

7. The method according to claim 2, wherein the hollow-profile blank is supported in the supporting step during the flattening step.

8. The method according to claim 1, further comprising the step of calibrating the hollow-profile blank into the final shape of the hollow profile by an internal high pressure exceeding the expansion pressure.

9. A device for producing a circumferentially closed hollow profile, comprising:

an internal high-pressure forming tool including an inside and an outside;

a plunger including a zone of engagement;

a pressure-medium feed connected to a pressure generator arranged on the outside of the tool, extending as a duct through the tool and issuing on the inside of the tool toward the cavity;

an arrangement configured to expand a hollow-profile blank by fluidic internal high pressure; and at least one elastic diaphragm fastened to the inside of the tool, the diaphragm extending laterally of the zone of engagement and expanded by a high pressure of the pressure-medium feed, the diaphragm configured to come to bear against the hollow-profile blank to be formed on at least one partial circumferential region in accordance with pressure applied to the diaphragm.

10. The device according to claim 9, further comprising a flattening device integrated into the internal high-pressure forming tool and configured to flatten the hollow-profile blank.

11. The device according to claim 10, wherein the tool includes a leadthrough, and the flattening device includes at least one plunger guided displaceably in the leadthrough.

12. The device according to claim 11, wherein the plunger includes a planar end face.

13. The device according to claim 9, wherein the diaphragm extends along the entire cavity of the tool.

14. The device according to claim 9, further comprising a holder arranged on the inside of the tool, the diaphragm including two ends arranged transversely to a longitudinal extent of the tool and received in the holder.

15. The device according to claim 9, wherein the tool includes a holder receptacle having a wall, and the diaphragm is firmly clamped between the inside of the tool and the wall of the holder receptacle.

16. The device according to claim 9, wherein a pressure medium configured to act on the diaphragm toward the hollow-profile blank includes a pressure fluid.

17. The device according to claim 9, wherein a recess is incorporated into the inside of the tool, the recess including a bottom and extending along the diaphragm and covered by the diaphragm, the diaphragm including an outside facing the recess bottom, the pressure-medium feed issuing into the recess, and wherein a pressure space is formable between the recess bottom and the outside of the diaphragm facing the recess bottom.

* * * * *